US008026885B2

(12) United States Patent
Maruyama et al.

(10) Patent No.: US 8,026,885 B2
(45) Date of Patent: Sep. 27, 2011

(54) DISPLAY DEVICE AND DISPLAY SYSTEM

(75) Inventors: Junichi Maruyama, Yokohama (JP); Yoshihisa Ooishi, Yokohama (JP); Kikuo Ono, Mobara (JP); Takashi Shoji, Fujisawa (JP)

(73) Assignee: Hitachi Displays, Ltd., Chiba (JP)

( * ) Notice: Subject to any disclaimer, the term of this patent is extended or adjusted under 35 U.S.C. 154(b) by 963 days.

(21) Appl. No.: 11/951,403

(22) Filed: Dec. 6, 2007

(65) Prior Publication Data

US 2008/0158212 A1 Jul. 3, 2008

(30) Foreign Application Priority Data

Dec. 8, 2006 (JP) ..... 2006-331315
Mar. 19, 2007 (JP) ..... 2007-069757

(51) Int. Cl.
*G09G 3/36* (2006.01)
*G09G 5/10* (2006.01)

(52) U.S. Cl. ..... 345/89; 345/690

(58) Field of Classification Search ..... 345/87–90, 345/98–99, 204, 690
See application file for complete search history.

(56) References Cited

U.S. PATENT DOCUMENTS

2002/0003522 A1* 1/2002 Baba et al. ..... 345/89
2004/0141094 A1* 7/2004 Kumamoto et al. ..... 348/554
2004/0155847 A1* 8/2004 Taoka et al. ..... 345/87
2006/0119617 A1* 6/2006 Toyooka et al. ..... 345/619
2006/0256141 A1* 11/2006 Maruyama et al. ..... 345/690
2007/0070212 A1* 3/2007 Haneda ..... 348/222.1
2007/0103585 A1* 5/2007 Takeuchi et al. ..... 348/441

FOREIGN PATENT DOCUMENTS

JP 2002-215111 7/2002
JP 2004-317928 11/2004

OTHER PUBLICATIONS

English Translation of JP 2004-317928.*

* cited by examiner

*Primary Examiner* — Amare Mengistu
*Assistant Examiner* — Hong Zhou
(74) *Attorney, Agent, or Firm* — Antonelli, Terry, Stout & Kraus, LLP.

(57) ABSTRACT

A display device and system are disclosed, wherein the display system is so configured that an n-fold rate increasing circuit is arranged with a signal generating device instead of with the display device to realize a low-cost n-fold rate impulse-type drive. The n-fold rate display data is output to the display device from the signal generating device, and the display device includes a circuit to subject the input n-fold rate display data to the data conversion process for the n-fold rate impulse drive. In addition to the n-fold rate display data, an identification signal for identifying the position of the turn of the frames of the original video signal is input to the display device to prevent the erroneous data conversion operation.

16 Claims, 11 Drawing Sheets

DISPLAY DEVICE AND DISPLAY SYSTEM

CLAIM OF PRIORITY

The present application claims priority from Japanese applications serial no. 2006-331315 filed on Dec. 8, 2006 and no. 2007-069757 filed on Mar. 19, 2007, the contents of which is hereby incorporated by reference into this application.

BACKGROUND OF THE INVENTION

This invention relates to a hold-type display device such as a liquid crystal display, an electroluminescence (EL) display or a liquid crystal on silicon display (LCOS), or in particular, to a display device and a display system suitable for displaying dynamic images.

The display devices can be classified roughly into an impulse-type display device and a hold-type display device from the viewpoint of dynamic image display. In the impulse-type display device such as the cathode-ray tube, the brightness of the pixels scanned is increased only during the scanning period and decreased immediately after scanning. The hold-type display device such as the liquid crystal display, on the other hand, continues to hold the brightness based on the display data until the next scanning period.

According to US Patent No. 2004/0155847, one frame period is divided into first and second periods, and the pixel data to be written in the pixels during the frame period are written concentratedly in the first period. In the process, the value written into the pixels is increased to the double of the image data value not to decrease the brightness of the image as a whole, and only in the case where the double value exceeds a displayable range, the residual pixel data is written in the second period. In this way, the change in display brightness approaches that of the impulse-type display device thereby to improve the visual recognizability of the dynamic image.

According to JP-A-2002-215111, on the other hand, a frame memory unit stores one frame of input video signal, and a frame rate conversion signal generating unit generates a clock signal, a horizontal sync signal and a vertical sync signal with the video signal frame rate converted in a magnification of 3 or more from the clock signal, horizontal sync signal and the vertical sync signal, respectively, synchronized with the input video signal. Also, the output signal of the frame memory unit and the video signal fixed at black level are switched and output by a video signal switching unit based on the switching signal output from a switching signal generating unit, so that the display period of one frame image is shortened arbitrarily.

In similar fashion, JP-A-2004-317928 discloses a liquid crystal display device comprising a frequency changing circuit 11 for outputting each input frame four times at a rate four times higher and a liquid crystal display element 15 for displaying each frame output 2N times, wherein the brightness level of every other conversion frame is converted to a lower level than the brightness level of the remaining every other conversion frame and supplied to the liquid crystal display element, thereby reducing the motion blur of the dynamic image caused at the time of each frame change.

The above-mentioned drive method is called the n-fold rate impulse-type drive below in this specification.

In the display device including an n-fold rate impulse-type drive described in US Patent No. 2004/0155847, the input display data is required to be plotted n times, i.e. the output display data is required to be rewritten within one frame period, which in turn requires an n-fold rate increasing means to increase the input display data to a rate n times higher. A frame memory is required, however, for the n-fold rate increase. Specifically, the cost of the display device having the n-fold rate impulse-type drive is higher than that of the normal display device by the amount of the frame memory. According to US Patent No. 2004/0155847, the first period data and the second period data are generated in the display device, and therefore, no consideration is given to the fact that in the case where the data for the first and second periods are generated outside the display device and input sequentially to the display device, the first period data and the second period data cannot be discriminated from each other.

SUMMARY OF THE INVENTION

An object of this invention is to provide a display device with the circuit size reduced by including an n-fold rate increasing circuit outside the display device.

Another object of the invention is to provide a display device having an external n-fold rate increasing circuit capable of identifying each of n fields in one frame period.

JP-A-2002-215111 and JP-A-2004-317928, in which a switching signal is generated to identify the frame increased in rate, fail to take into consideration the delay due to the write and read operation of the frame memory.

Still another object of the invention is to provide a display device capable of accurately identifying the field periods in one frame period.

According to this invention, there is provided a display system comprising an n-fold rate increasing circuit arranged on the signal generating device side but not on the display device side, wherein the n-fold rate display data n times higher in speed than the original input display data is output from the signal generating device to the display device which executes the process of data conversion of the input n-fold rate display data for the impulse-type drive thereby to carry out the n-fold rate impulse-type drive operation. At the same time, in order to prevent the erroneous operation of the data conversion process, a frame sync signal for identifying the frame switching point of the original input display data is input to the display device in addition to the n-fold rate display data.

As an alternative, the field identification signal for identifying the frame switching point of the original input display data is generated from the n-fold rate display data by a field repetition detection circuit in the display device.

According to this invention, there are provided a hold-type display device and a display system including the same display device, wherein the display characteristic of the impulse-type display device is realized by using the n-fold rate impulse-type drive and thus a superior display quality free of dynamic image blurs can be obtained. Further, according to this invention, the display device and the display system are made available at a lower cost than in the case where the n-fold rate impulse-type drive is carried out in the display device.

In other words, according to this invention, the provision of the n-fold rate increasing circuit outside the display device can reduce the circuit size of the display device.

Also, according to this invention, the display device can identify each of n field periods in one frame period even in the case where the n-fold rate increasing circuit is arranged outside the display device.

Further, according to this invention, each field period is identified taking the delay due to the rate increase operation into consideration, and therefore, the display device can accurately identify the field periods in one frame period.

DETAILED DESCRIPTION OF THE INVENTION

Now, an example of the method of configuring the display device and the display system according to this invention is explained.

First, the n-fold rate impulse-type drive according to an embodiment of the invention is explained with reference to FIGS. 1A to 1D, FIG. 2 and FIGS. 3A to 3D.

After that, two examples of the configuration of the display device carrying the n-fold rate impulse-type drive and the problems thereof are explained with reference to FIGS. 4A, 4B.

Figure 6:
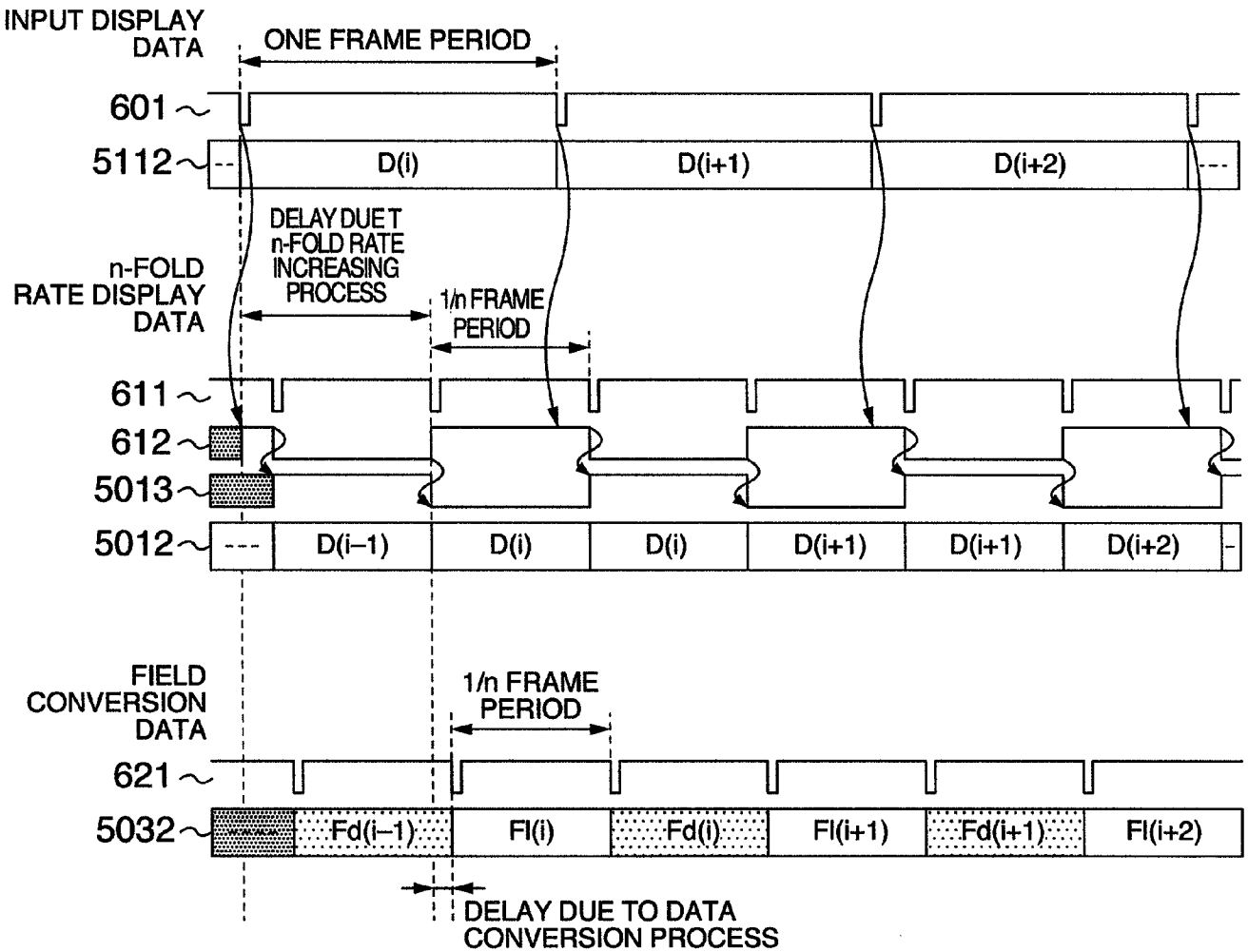
FIG. 6 is a diagram showing an example of the operation of the display device and the display system according to the first embodiment of the invention.

Next, with reference to FIG. 6, a first embodiment of the invention for solving the aforementioned problems is explained.

According to the first embodiment, there are provided a display device and a display system configured to arrange the n-fold rate increasing circuit on the signal generating device side and output a sync signal from the signal generating device to the display device in order to realize the n-fold rate impulse-type drive at a low cost.

Figure 8:
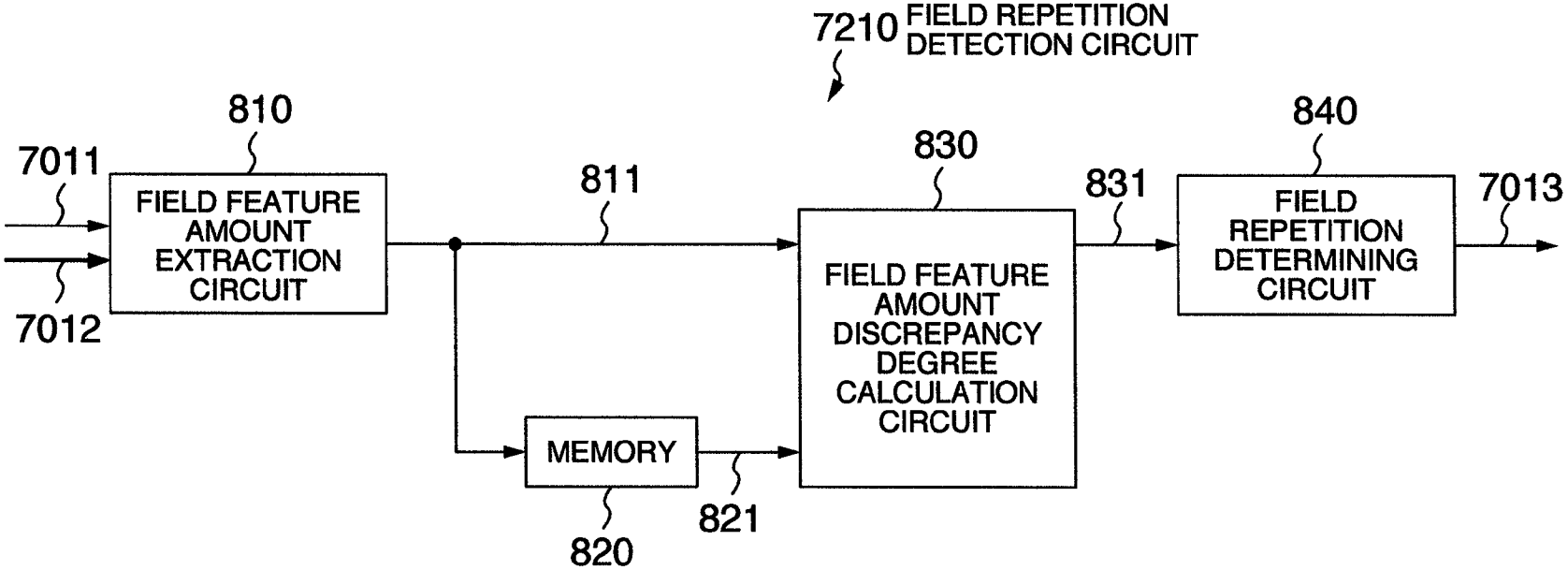
FIG. 8 is a diagram showing an example of the configuration of a field repetition detection circuit of the display device according to the second embodiment of the invention.

Next, with reference to FIG. 8, a second embodiment of the invention to solve the aforementioned problems is explained.

According to the second embodiment, there are provided a display device and a display system configured to arrange a frame repetition detection circuit in the display device.

In the description of the n-fold rate impulse-type drive that follows, n is 2. The value of n, however, is not limited to 2 but may be larger.

First Embodiment

Figure 1A:
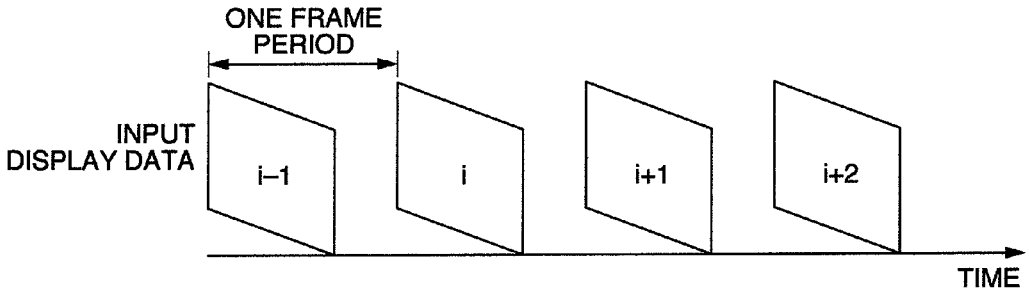
FIGS. 1A to 1D are diagrams for explaining the concept of the n-fold rate impulse-type drive according to the invention.
Figure 1B:
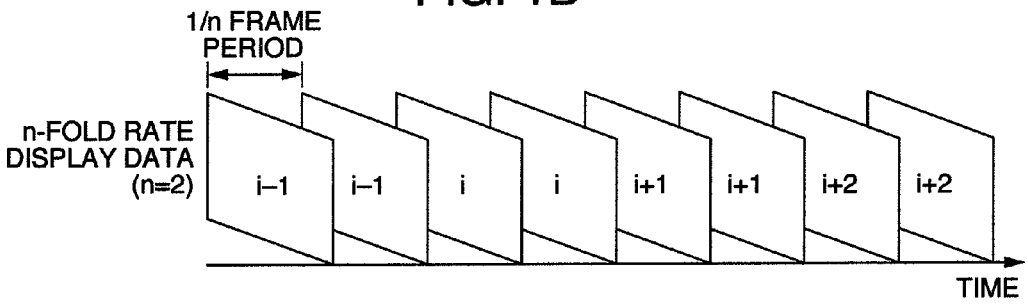
Figure 1C:
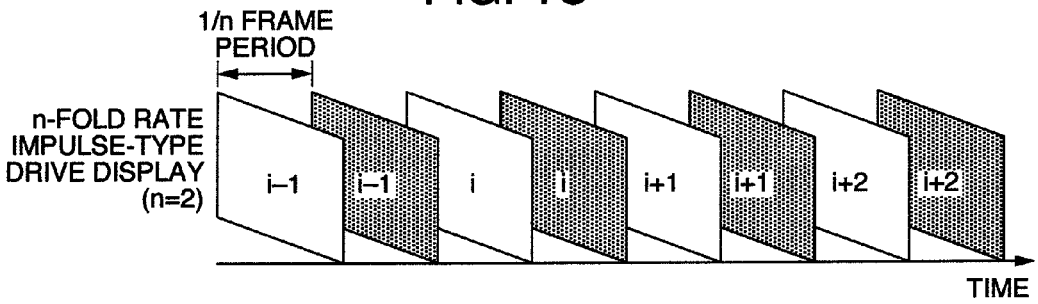
Figure 1D:
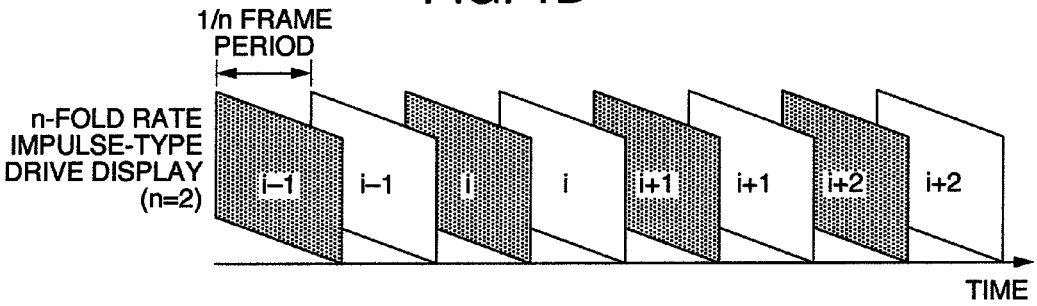

FIGS. 1A and 1D schematically show the processing steps for the n-fold rate impulse-type drive. As explained above, n is 2 in this case. The abscissa represents the time elapsed.

FIG. 1A shows the input display data. The video data sampled in every other frame period are sequentially input. One frame period is 16.6 ms, for example, in the video data of the TV signal according to the NTSC standard. In this case, the frame frequency is 60 Hz, Next, the frame frequency of the input display data is increased by n times.

FIG. 1B shows the n-fold rate display data in which the frame frequency of the input display data shown in FIG. 1A is increased by n times. In the case where the input display data is the NTSC signal and n is 2, for example, the frame frequency of the n-fold rate display data is 120 Hz. The same input display data is output two times repeatedly during one frame period of the input display data. In this case, the interval at which the display data is updated equals 1/n of the frame period.

Finally, the n-fold rate display data is subjected to the conversion for the impulse-type drive and displayed on a display panel.

FIG. 1C shows a display example of the n-fold rate impulse-type drive. The n-fold rate display data shown in FIG. 1B is subjected to the conversion thereby to generate and display the first and second field signals. The data is displayed brighter than the original input display data in the first field signal and darker than the original input display data in the second field thereby to realize the display characteristic of impulse type. In the process, the first and second fields are temporally integrated to prevent the reduction in brightness which otherwise might be caused due to the change in the display characteristic by the control operation to make recognizable the brightness corresponding to the original input display data.

FIG. 1D shows another display example of the n-fold rate impulse-type drive. The n-fold rate display data shown in FIG. 1B is subjected to the data conversion thereby to generate and display the first field signal and the second field signal. In the first field signal, the data is displayed darker than the original input display data, while in the second field signal, the data is displayed brighter than the original input display data thereby to achieve the display characteristic of impulse type. In the process, the first field and the second field are temporally integrated to prevent the brightness reduction which otherwise might be caused due to the change in the display characteristic by the control operation to make recognizable the brightness corresponding to the original input display data.

By controlling the display device in the steps described above, the n-fold rate impulse-type drive can be realized. Thus, the impulse-type display characteristic is realized even for the hold-type display device, and a satisfactory display quality substantially free of dynamic image blurs is obtained.

Figure 2:
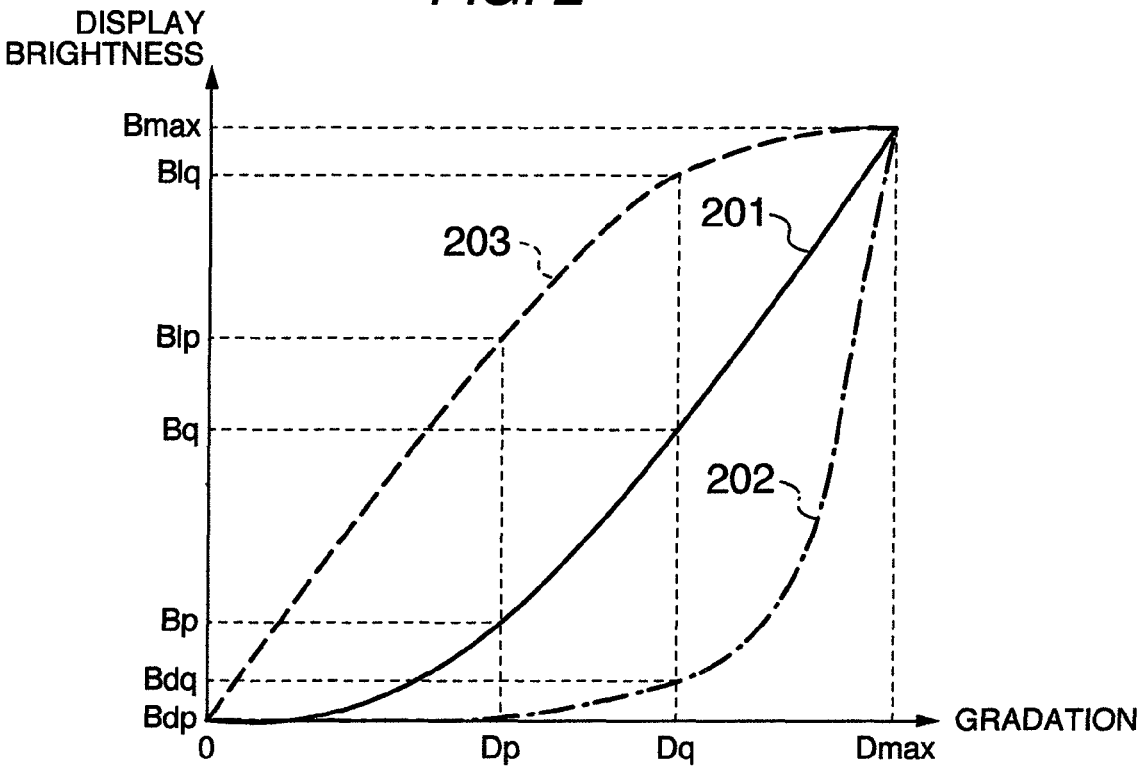
FIG. 2 is a diagram showing an example of correspondence between the gradation and the display brightness in the n-fold rate impulse-type drive according to the invention.

FIG. 2 is a diagram showing an example of the relation (what is called the y characteristic) between the display brightness of the first field and the display brightness of the second field for the input display data in the n-fold rate impulse drive.

The abscissa represents the gradation of the input display data and the ordinate the display brightness. The solid line indicates an example of the normal drive. The dashed line 203 and the one-dot chain 202 show an example of display brightness of the first field and the display brightness of the second field, respectively, in the n-fold rate impulse-type drive.

In the normal drive, for example, the display brightness of the input display data of gradation Dp is given as Bp, and the display brightness of the input display data of gradation Dq as Bq. Also for the other gradations, as shown in the example of FIG. 2, the gradation and the display brightness are shown in correspondence with each other.

In the n-fold rate impulse-type drive, in contrast, the display brightness Blp is assigned to the first field and the display brightness Bdp to the second field for the input display data of gradation Dp. The data is displayed with the display brightness Blp in the first field period, followed by the data display with the display brightness Bdp in the second field period. In this way, adjustment is made so that the display brightness corresponding to the display brightness Bp is recognizable over one frame period. As for the input display data of gradation Dq, on the other hand, the display brightness of the first field is set to Blq and the display brightness of the second field to Bdq. In this case, the data is displayed with the display brightness Blq in the first field period, and with the display brightness Bdq in the second field period. In this way, the adjustment is made so that the display brightness corresponding to the display brightness Bp is recognizable over one frame period. With regard to the other gradations, as shown in the example of FIG. 2, the display brightness of the first field and the display brightness of the second field are set in correspondence with each other.

Examples of the configuration of the n-fold rate impulse-type drive are explained above in which the first field is determined as a bright field displayed with a relatively high brightness and the second field as a dark field displayed with a relatively low brightness. Alternatively, however, the first field may be determined as a dark field and the second field as a bright field.

Figure 3A:
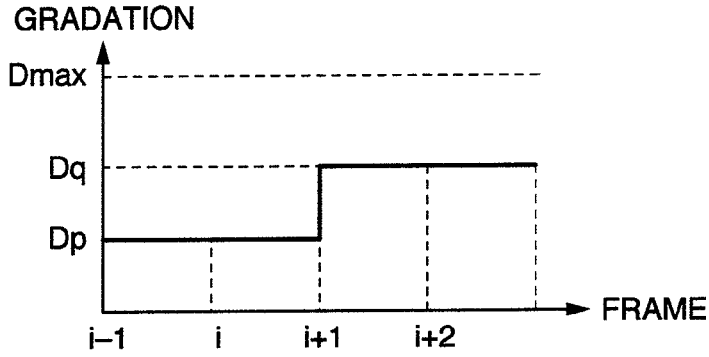
FIGS. 3A to 3D are graphs showing an example of the input display data for the n-fold rate impulse-type drive and the manner in which the display brightness is changed by the n-fold rate impulse-type drive operation of the input display data according to the invention.

FIG. 3A is a graph showing an example of the manner in which the input display data for a given pixel of the display device undergoes a change. The abscissa represents the frame (i.e. the time) and the ordinate the gradation.

In the example of the input display data shown in FIG. 3A, the gradation is Dp for the (i−1)th frame and the ith frame and Dq for the (i+1)th frame and the (i+2)th frame.

For this input display data, the conventional display device is driven for display with the display brightness Bp corresponding to the gradation Dp in the (i−1)th and ith frame, and with the display brightness Bq corresponding to the gradation Dq in the (i+1)th and the (i+2)th frames.

Next, an example of the n-fold rate impulse-type drive is explained.

Figure 3B:
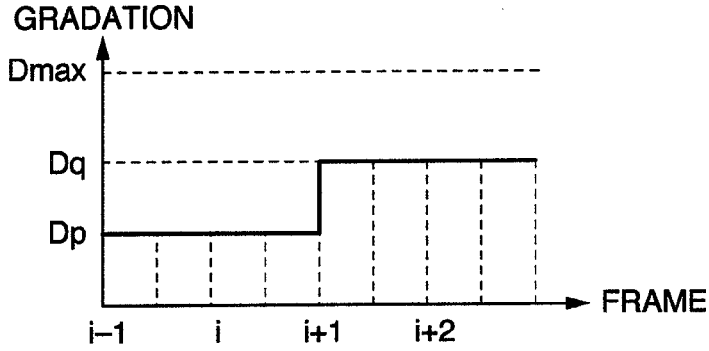
Figure 3C:
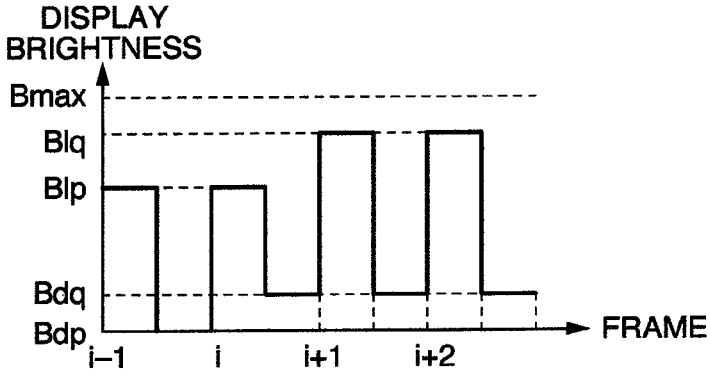
Figure 3D:
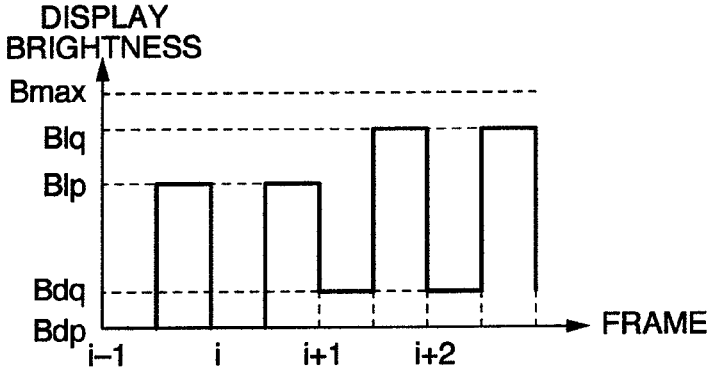

FIGS. 3B, 3C and 3D show graphs showing the manner in which the process is executed by the display device and the display system in the case where the input display data is subjected to the n-fold rate impulse-type drive operation.

FIG. 3B shows an example of the n-fold rate display data with the input display data of FIG. 3A increased by n times in rate. Like in FIG. 3A, the abscissa represents the frame (i.e. the time) and the ordinate the gradation. The n-fold rate display data is equivalent to the same input display data output n times repeatedly during one frame period.

FIG. 3C is a diagram showing an example of the manner in which the display brightness changes in the case where the display device is driven by the output display data obtained from the n-fold rate display data shown in FIG. 3B subjected to the data conversion process for impulse-type drive. Like in FIG. 3A, the abscissa represents the frame (i.e. the time) and the ordinate the display brightness.

FIG. 3C shows an example configuration in which the first field is determined as a bright field displayed with a relatively higher brightness and the second field as a dark field displayed with a relatively lower brightness. This corresponds to the example shown in FIG. 1C.

For the n-fold rate display data shown in FIG. 3B, the display device is driven to display the data with the display brightness Blp corresponding to the gradation Dp in the first field of the (i−1)th and ith frames, with the display brightness Bdp corresponding to the gradation Dp in the second field of the (i−1)th and ith frames, with the display brightness Blq corresponding to the gradation Dq in the first field of the (i+1)th and (i+2)th frames, and with the display brightness Bdq corresponding to the gradation Dq in the second field of the (i+1)th and (i+2)th frames.

FIG. 3D is a diagram showing another configuration example different from FIG. 3C, showing the manner in which the display brightness of the display device undergoes a change after the n-fold rate display data shown in FIG. 3B is subjected to the data conversion process. Like in FIG. 3A, the abscissa represents the frame (i.e. the time) and the ordinate the display brightness.

FIG. 3D shows an example of the configuration in which the first field is determined as a dark field with a relatively low brightness and the second field as a bright field with a relatively high brightness. This corresponds to the example shown in FIG. 1D.

For the n-fold rate display data shown in FIG. 3B, the display device is driven to display the data with the display brightness Bdp corresponding to the gradation Dp in the first field of the (i−1)th and ith frames, with the display brightness Blp corresponding to the gradation Dp in the second field of the (i−1)th and ith frames, with the display brightness Bdq corresponding to the gradation Dq in the first field of the (i+1)th and (i+2)th frames, and with the display brightness Blq corresponding to the gradation Dq in the second field of the (i+1)th and (i+2)th frames.

As shown in FIGS. 3C and 3D, the n-fold rate impulse-type drive is so configured to have a plurality of variations with different in display characteristics according to the order in which the bright and dark fields are arranged.

The n-fold rate impulse-type drive in the display device and the display system according to the invention is briefly described above. Now, two example configurations of the display device and the display system carrying the n-fold rate impulse-type drive are explained, together with the problems thereof, with reference to FIG. 4.

Figure 4A:
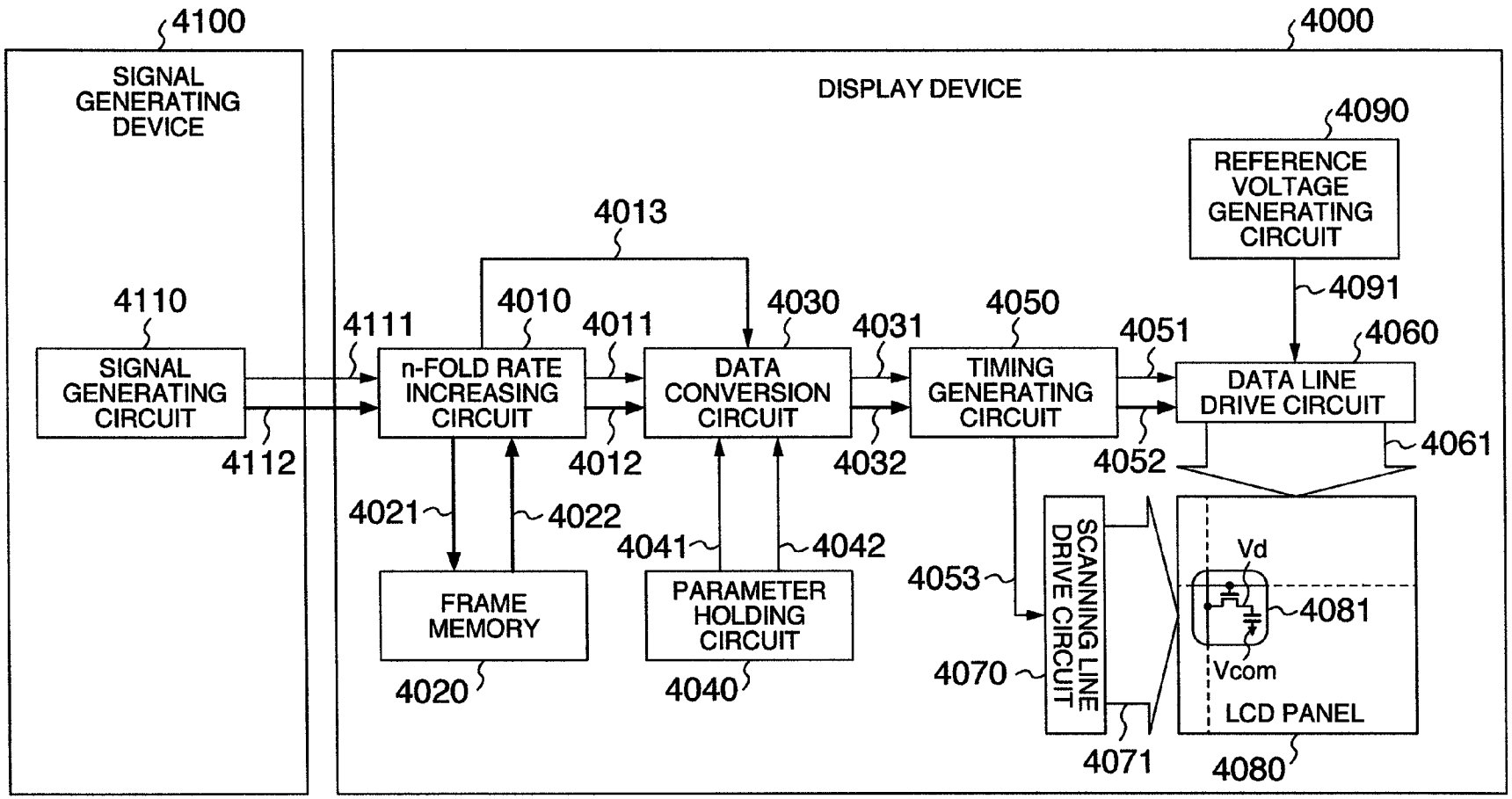
FIGS. 4A and 4B are diagrams showing an example of the display device and the display system having the n-fold rate impulse-type drive according to this invention.

FIG. 4A is a diagram showing an example of the configuration of the display device and the display system for realizing the n-fold rate impulse-type drive. Incidentally, the liquid crystal display shown in FIG. 4 as a display device may be replaced with any display device operated on other display principles.

The display system, for example, is the TV set proper, the PC proper or the mobile phone proper.

The display system includes a signal generating device 4100 and a display device 4000.

The signal generating device 4100 is configured of, for example, a group of signal processing circuits of a TV receiver or a video recorder/player or a group of graphics processing circuits of a PC or a mobile phone. The signal generating device 4100 includes a signal generating circuit 4110 for generating an input display data 4112 and a group of input control signals 4111 output to the display device 4000.

The display device 4000 includes an n-fold rate increasing circuit 4010, a data conversion circuit 1030, a timing generating circuit 4050, a frame memory 4020, a parameter holding circuit 4040, a data line drive circuit 4060, a scanning line drive circuit 4070, a liquid crystal display panel 4080 and a reference voltage generating circuit 4090.

The display device 4000 has the functions of receiving the input display data 4112 and the input control signals 4111 input thereto and driving the liquid crystal display panel 4080 by using the n-fold rate impulse-type drive for the input display data 4112 and the input control signals 4111.

The input control signals 4111 are configured of, for example, a vertical sync signal defining one frame period (the period for displaying one screen), a horizontal sync signal defining one horizontal scanning period (the period for displaying one line), an effective data period signal defining the effective period of the display data and a reference clock signal synchronized with the display data.

The input display data 4112 and the input control signal group 4111 are transferred from the signal generating device 4100 to the display device 4000. For this transfer, various electrical signal levels such as LVDS level, COMS level or LVTTL level can be used. In the case where the signal generating device 4100 and the display device 4000 are arranged far from each other in the display system, a transfer method capable of long-distance transmission with low noises is desirably used for the transfer.

The n-fold rate increasing circuit 4010 generates the n-fold rate display data 4012 in which the frame frequency of the input display data 4112 is increased by n times.

More specifically, the n-fold rate increasing circuit 4010 stores the input display data 4112 sequentially in the frame memory 4020. The stored data for the one frame period, on the other hand, is read, if any, within the time equal to one of n divisions of one frame period. Further, the frame frequency can be increased by n times by performing the aforementioned read operation n times in one frame period.

The input display data read in the first read session is used as the n-fold rate display data for the first field, and the input display data read in the second read session as the n-fold rate display data for the second field.

Reference numeral 4021 designates the data written into the frame memory 4020, and numeral 4022 the data read from the frame memory 4020.

Also, the n-fold rate increasing circuit 4010 generates a field identification signal 4013 and an n-fold rate control signal group 4011.

The field identification signal 4013, synchronized with the n-fold rate display data 4012, is used to determine which of the first field or the second field is associated with the n-fold rate display data 4012. Specifically, the field identification signal 4013 is synchronized with the read clock for the display data from the frame memory 4020.

The n-fold rate control signal group 4011 is configured of, for example, an n-fold rate vertical sync signal for defining one field period, an n-fold rate horizontal sync signal for defining one horizontal scanning period, an n-fold rate display data effective period signal for defining the effective period of the n-fold rate display data and an n-fold rate clock signal synchronized with the n-fold rate display data.

The frame memory 4020, which is a storage element having the capacity sufficient to store the display data of at least one frame, executes the process of writing the input display data and reading the n-fold rate display data.

The frame memory 4020 may be, for example, any of various DRAMs (dynamic random access memories).

The data conversion circuit 4030, which generates the field conversion data 4032 for carrying out the n-fold rate impulse-type drive, receives the n-fold rate display data 4012 as an input from the n-fold rate increasing circuit 4010 and converts the n-fold rate display data 4012 into the field conversion data 4032 for each field in accordance with a predetermined data conversion rule.

The data conversion rule is input to the data conversion circuit 4030 as n field conversion parameters 4041, 4042.

The data conversion circuit 4030 identifies the field by the field identification signal 4013 and selects the parameter for each field.

The first field conversion parameter 4041 determines the data conversion rule for the first field.

The second field conversion parameter 4042 determines the data conversion rule for the second field.

In the case where one frame is divided into two or more fields by the n-fold rate impulse-type drive, the nth field conversion parameter is preferably prepared for each field.

The data conversion rule is appropriately determined to secure a satisfactory display quality without causing any false contour or color shift taking the effects of the number n of frame divisions, the environmental temperature of the display device, the temperature of the liquid crystal display panel, the set amount of the reference voltage, the length of one frame period and the length of each field period into consideration.

The data conversion rule may be determined in accordance with an arithmetic formula with the aforementioned various conditions as parameters or by referring to the lookup table with the aforementioned conditions as an index.

In the data conversion circuit 4030, the n-fold rate control signal group 4011 input from the n-fold rate increasing circuit 4010 is adjusted in timing into synchronism with the field conversion data 4032 and output as a field conversion data control signal group 4031.

The timing generating circuit 4050 receives the field conversion data control signal group 4031 and the field conversion data 4032 as an input from the data conversion circuit 4030. From the field conversion data control signal group 4031 and the field conversion data 4032, the timing generating circuit 4050 generates a data line drive circuit control signal group 4051 for controlling the data line drive circuit 4060, an output display data 4052 and a scanning line drive circuit control signal group 4053 for controlling the scanning line drive circuit 4070.

The parameter holding circuit 4040 holds the various setting parameters including the field conversion parameters 4041, 4042 used in the data conversion circuit 4030. The parameter holding circuit 4040 also has the function of reading the various setting parameters from an external storage device (not shown).

The parameter holding circuit 4040 includes a plurality of storage elements such as a register file and various RAMs (random access memories) and a control circuit for a memory circuit.

The memory circuit (not shown) used to store the various setting parameters described above can be, for example, any of various nonvolatile memories including a ROM (read-only memory), an EEPROM (electrically erasable programmable ROM) and a flash memory.

The data line drive circuit control signal group 4051 is configured of, for example, an output timing signal for defining the output timing of the gradation voltage based on the output display data 4052, an AC signal for determining the polarity of the source voltage and the clock signal synchronized with the display data.

The scanning line drive circuit control signal group 4053 is configured of, for example, a shift signal for defining the scanning period of one line and a vertical start signal for defining the scanning start of the head line.

Numeral 4090 designates a reference voltage generating circuit, and numeral 4091 a reference voltage.

The data line drive circuit 4060 generates a potential corresponding to the number of the display gradations from the reference voltage 4091 on the one hand, and selects a potential of one level corresponding to the output display data 4052 and applies the same potential to the liquid crystal display panel 4080 as a data voltage on the other hand. Numeral 4061 designates a data voltage generated by the data line drive circuit.

Numeral 4070 designates a scanning line drive circuit, and numeral 4071 a scanning line select signal.

The scanning line drive circuit 4070, based on the scanning line drive circuit control signal group 4053, generates the scanning line select signal 4071 and outputs it to a liquid crystal display panel 4080.

Numeral 4080 designates the liquid crystal display panel, and numeral 4081 a schematic diagram of one pixel of the liquid crystal display panel. Each pixel 4081 of the liquid crystal display panel 4080 is configured of a TFT (thin film transistor) including a source electrode, a gate electrode and a drain electrode, a liquid crystal layer and opposed electrodes. By applying the scanning signal to the gate electrode, the switching operation of the TFT is performed. The data voltage is written into the drain electrode connected to one side of the liquid crystal layer through the source electrode in the open state of the TFT, while the voltage written into the drain electrode is held in the closed state of the TFT. Let Vd the voltage across the drain electrode, and VCOM the voltage between the opposed electrodes. The liquid crystal layer changes the direction of polarization based on the potential difference between the drain electrode voltage Vd and the opposed-electrode voltage VCOM on the one hand, and the amount of the light transmitted from the backlight arranged on the back is changed for gradation display through the polarizers arranged above and under the liquid crystal layer.

An example of the configuration of the display system for realizing the n-fold rate impulse-type drive is explained above with reference to FIG. 4A. The configuration shown in FIG. 4A, however, requires an n-fold rate increasing circuit 4010 and a frame memory 4020 with the display device 4000, thereby posing the problem of an increased cost of the display device 4000.

Figure 4B:
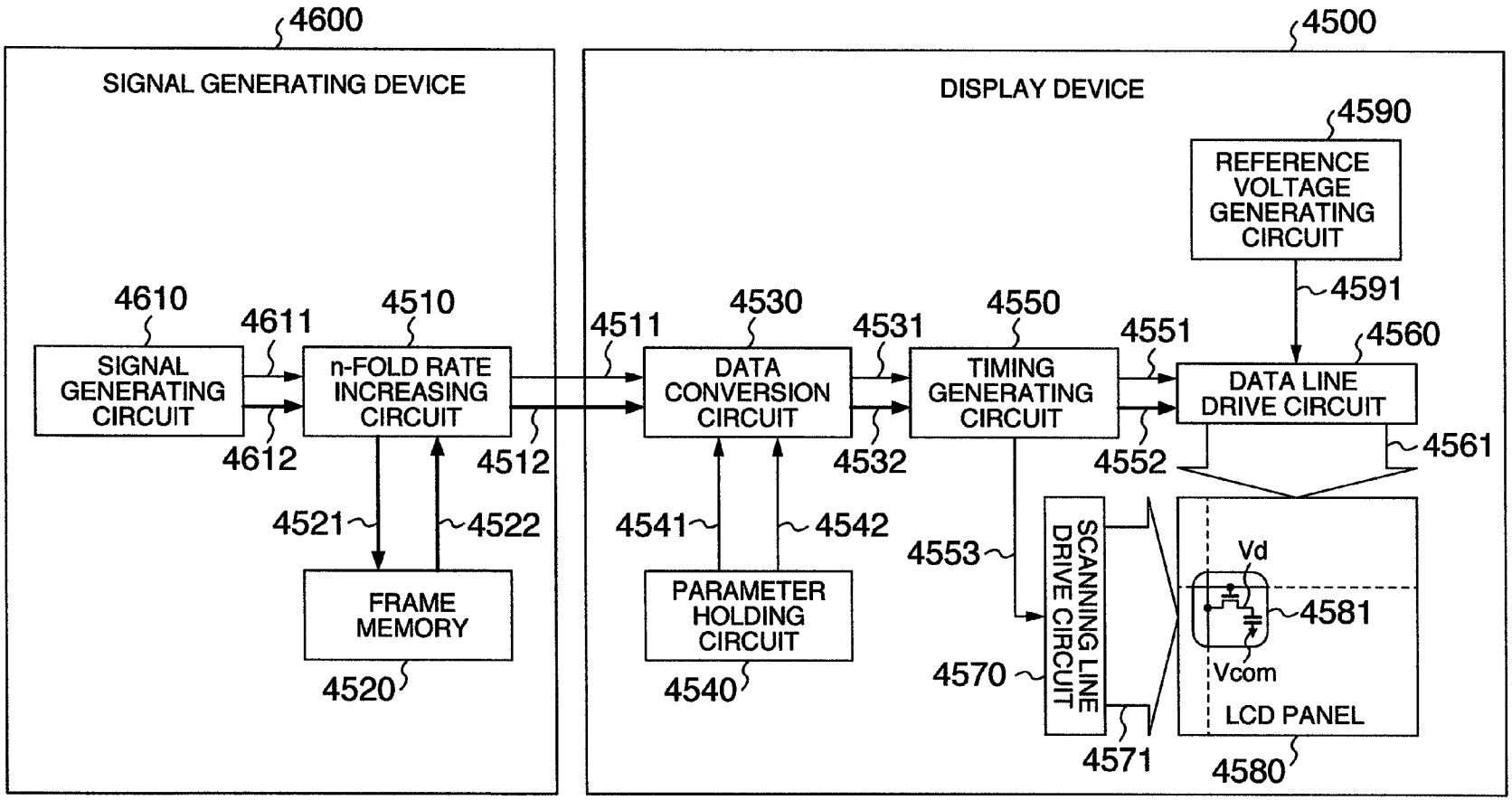

Another example of the configuration of the display system for realizing the n-fold rate impulse-type drive is shown in FIG. 4B.

This configuration is different from the configuration shown in FIG. 4A in that an n-fold rate increasing circuit 4510 and a frame memory 4520 are arranged with the signal generating device 4600 instead of with the display device 4500, and the n-fold rate display data 4512 and the n-fold rate control signal group 4511 are transmitted from the signal generating device 4600 to the display device 4500. The n-fold rate display data 4512 remains the same as the corresponding data in the configuration of FIG. 4A.

The other points are equivalent to those of the configuration shown in FIG. 4A and therefore not described again.

Generally, the signal generating device is required to execute a complicated signal processing such as various format conversions (the image resolution conversion, the interlace progressive conversion, etc.) and the image correcting process (the edge highlighting, the color tone correction, etc.), and therefore, includes a signal processing circuit higher in performance than the display device. The cost increase caused by arranging the n-fold rate increasing circuit and the frame memory with the signal generating device can be said to be smaller than the cost increase caused by arranging them with the display device. In other words, by arranging as the n-fold rate increasing circuit and the frame memory with the signal generating device, the whole display system can be realized at a lower cost.

In the configuration shown in FIG. 4B, however, the n-fold rate display data 4512 and the n-fold rate control signal group 4511, instead of the input display data 4612 and the input control signal 4611, are input to the display device 4500, and therefore, the display device 4500 cannot identify the turn of the frames of the original input display data 4612. Specifically, the switching operation between the first and second fields cannot be synchronized with the turn of the frames. This poses the problem that which of FIGS. 3C and 3D indicates the data conversion result of the data conversion circuit 4530 cannot be arbitrarily controlled. Specifically, in spite of the fact that the first field is a bright field and the second field a dark field in a given state as shown in FIG. 3C, an uncontrollable situation may randomly occur in which the first field is a dark one and the second field a bright one in another state as shown in FIG. 3D. In such a situation, the difference in display characteristic between FIGS. 3C and 3D inconveniently results in a random variation of the display image under the effect of the state of the display system (for example, the timing of switching on power) in spite of the same input display data 4612.

Also, the input display data 4612 itself is variously changed by the operation of the signal generating device 4600. The variation at the time of switching the receiving channel or the image source of the TV receiver and the variation due to the irregular display such as rapid feed or rewind mode in the video recorder/player are some examples. Each time of this operation, the display characteristic of the display system is inconveniently and unknowingly switched to the state of FIG. 3C or 3D at random in an unstable fashion.

From the viewpoint of display stability, the display system is desirably configured in such a manner that the display characteristic of the display device can be controlled arbitrarily. Specifically, a mechanism is required whereby the turn of the frames of the input display data can be identified and synchronized with the field switching operation.

Two examples of the configuration of the display device and the display system carrying the n-fold rate impulse-type drive and the problems thereof are described above.

Next, the display device and the display system according to the invention for solving the above-mentioned problems are explained below with reference to FIGS. 5 and 6.

Figure 5:
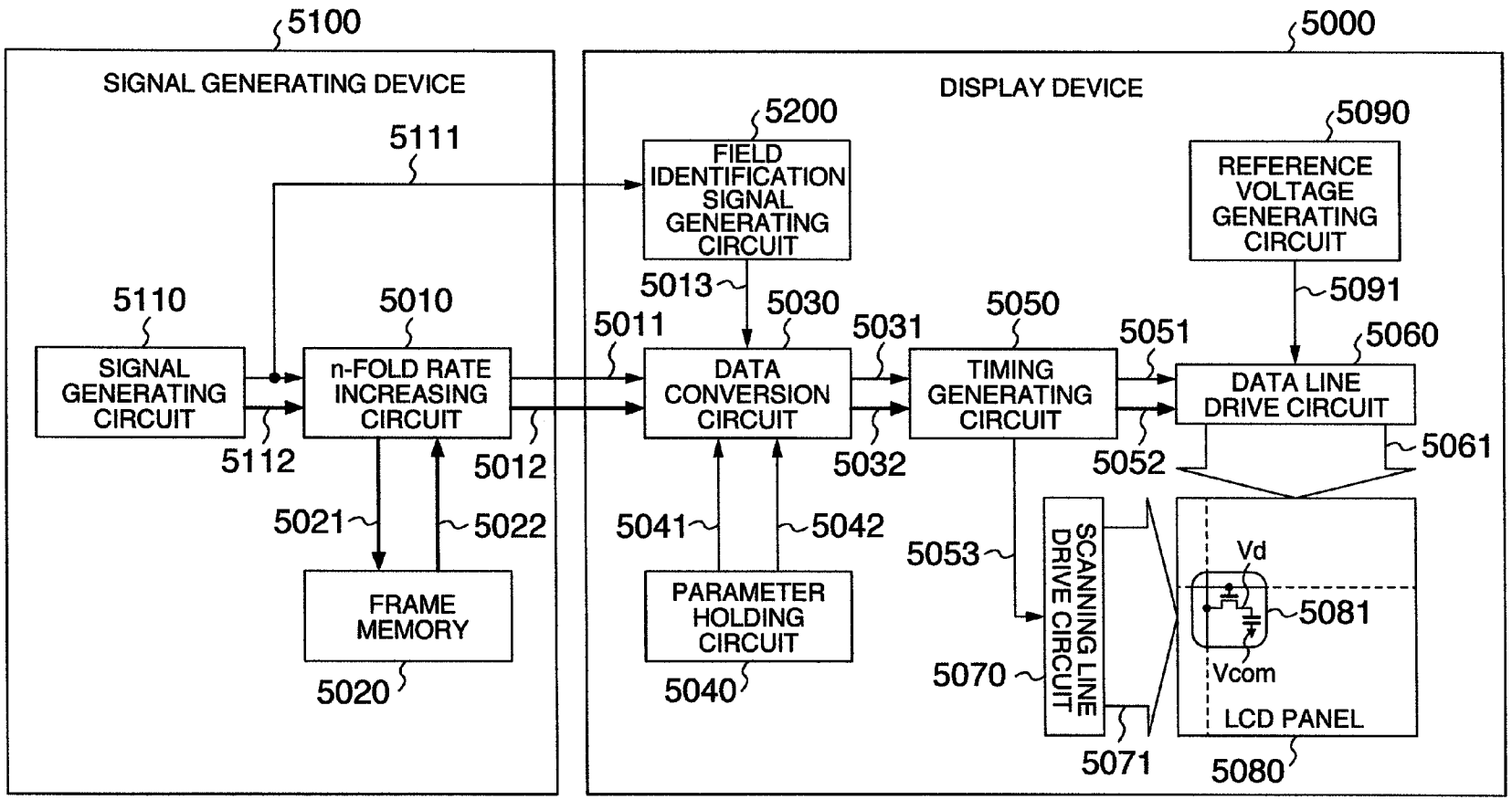
FIG. 5 is a diagram showing an example of the configuration of the display device and the display system according to a first embodiment of the invention.

FIG. 5 is a diagram showing an example of the configuration of the display system and the display device 5000 according to an embodiment of the invention for realizing the n-fold rate impulse-type drive with the above-mentioned problems solved.

The configuration shown in FIG. 5 is different from the configuration shown in FIG. 4A in that the n-fold rate increasing circuit 5010 and the frame memory 5020 are arranged on the signal generating device 5100 side instead of on the display device 5000 side and in that the n-fold rate display data 5012, the n-fold rate control signal group 5011 and the input control signal 5111 are transmitted from the signal generating device 5100 to the display device 5000. Another difference lies in that the field identification signal for identifying the turn of the frames of the input display data 5112 are not generated by the n-fold rate increasing circuit 5010 by the n-fold rate increasing circuit 5010 and input to the data conversion circuit 5030, but a field identification signal generating circuit 5200 generates a field identification signal 5013 from the original input control signal 5111.

The other points are similar to those of the configuration shown in FIG. 4A and not described below.

The configuration shown in FIG. 5 is also different from the configuration shown in FIG. 4B in that the input control signal 5111 of the original input display data 5112 is input to the display device 5000 from the signal generating device 5100.

As described above, from the viewpoint of display stability, the display device 5000 is desirably configured so that the display characteristic can be arbitrarily controlled for the n-fold rate impulse-type drive. For this purpose, the turn of the frames of the input display data 5112 is required to be identified and can be easily and effectively identified by use of the input display signal 5111 of the input display data 5112. The input vertical sync signal constituting one of the input control signals 5111, for example, defines one frame period of the input display data 5112, and therefore, can be suitably used for identifying the turn of the frames of the input display data 5112.

Based on the input vertical sync signal, the field identification signal 5013 is generated by the field identification signal generating circuit 5200 and used for field identification. Then, the inconvenience of the random variation in the display characteristic of the display system can be obviated and the stable display is made possible.

Incidentally, one of the input control signals 5111 other than the input vertical sync signal may be used.

An example of the configuration of the display device and the display system according to an embodiment of the invention is explained above with reference to FIG. 5.

FIG. 6 is a diagram showing an example of the operation of the display device and the display system according to an embodiment of the invention. This diagram shows an example of the timing chart of the operation of the display device and the display system shown in FIG. 5.

In FIG. 6, the abscissa represents the time.

First, the input display data 5112 and the input control signal group 5111 are output from the signal generating circuit 5110.

In the case of FIG. 6, the input vertical sync signal 601 constituting one of the input control signals 5111 and the input display data 5112 are shown. The input vertical sync signal group 601 includes signals for defining one frame period, and an event is generated in synchronism with the turn of the frames of the input display data 5112.

Also, in FIG. 6, reference character D(i) designates the input display data for the ith frame. In similar fashion, the character D(i+1) designates the input display data for the (i+1) the frame.

The data of each frame included in the input display data 5112 are input sequentially in units of one frame period in the order of, for example, D(i), D(i+1), D(i+2) and so on.

Next, the n-fold rate increasing process is executed by the n-fold rate increasing circuit 5010.

The signals shown in example of FIG. 6 include the n-fold rate vertical sync signal 611 constituting one of the n-fold rate control signals 5011 generated by the n-fold rate increasing circuit 5010, the n-fold rate display data 5012, and the field identification signal 5013 generated from the input vertical sync signal 601 by the field identification signal generating circuit 5200. The n-fold rate vertical sync signal 611 defines one field period of the n-fold rate display data 5012, and an event is generated in synchronism with the turn of the fields of the n-fold rate display data 5012.

Incidentally, as shown in FIG. 6, a delay due to the n-fold rate increasing process generally occurs between the input vertical sync signal 601 and the input display data 5112 on the one hand and the n-fold rate vertical sync signal 611 and the n-fold rate display data 5012 on the other hand. After occurrence of an event of the input vertical sync signal 601, the first field period is started from the time point when the first event of the n-fold rate vertical sync signal 611 occurs. This delay is caused by, for example, the difference between the timing at which the display data is written into the frame memory 5020 and the timing at which the display data is read from the frame memory 5020 by the n-fold rate increasing circuit 5010. The n-fold rate increasing circuit 5010 can read the display data for 1/n frame from the frame memory 5020 following the timing at which the display data for 1/n frame is written into the frame memory 5020. The n-fold rate increasing circuit 5010, therefore, can start to read the display data from the frame memory 5020 within a time shorter than one frame period from the time at which the display data starts to be written into the frame memory 5020.

The field identification signal generating circuit 5200 generates a field identification signal 5013 from the input vertical sync signal 601. The field identification signal 5013 is used to identify a field. According to this embodiment, one frame is divided into two fields including the first and second fields, and therefore, the field identification signal 613 is configured of, for example, a signal for toggling the two values including a signal level (low level) indicating the first field and a signal level (high level) indicating the second field for each one field period.

In the case where n is 2, the field identification signal 5013 is generated, for example, by the following steps.

First, a field identification preparation signal 612 is generated for reversing the low and high levels in synchronism with the n-fold rate vertical sync signal 611. Further, the field identification preparation signal 612 is always set to high level in synchronism with the input vertical sync signal 601. After that, the field identification signal 5013 latches the field identification preparation signal 612 in synchronism with the n-fold rate vertical sync signal 6111. In this way, the low level is secured in the first field and the high level in the second field, as shown in FIG. 6.

In this configuration, assume that the input control signal group 5111 or the input display data 5112 undergoes a variation for some reason (for example, the channel switching operation in the case where the display system is TV or the rapid feed or the rewind operation in the case where the display system is the video recorder/player) and the field identification signal 5013 or the field identification preparation signal 612 assumes an indefinite or an abnormal value with the result that the fields cannot be identified normally. Even in such a case, the normal field identification operation can be started again from the next field simply by receiving the input vertical sync signal 601 as an input signal. Thus, the operation stability of the display device is improved.

A method of generating the field identification signal 5013 in the field identification signal generating circuit 5200 is explained above by citing an example of the configuration using the input vertical sync signal 601. Nevertheless, the method of generating the field identification signal according to the invention is not limited to the cited example.

Then, the data conversion circuit 5030 executes the data conversion process on the n-fold rate display data 5012.

The data conversion circuit 5030 receives as an input the field identification signal 5013 output from the field identification signal generating circuit 5200 and the n-fold rate display data 5012 output from the n-fold rate increasing circuit 5010. The data conversion circuit 5030 identifies the first and second fields based on the field identification signal 5013, and in the case where the n-fold rate display data is associated with the first field (i.e. in the case where the field identification signal 5013 is low in level), performs the data conversion based on the first field conversion parameter 5041, while in the case where the n-fold rate display data is associated with the second field (i.e. in the case where the field identification signal 5013 is high in level), on the other hand, the data conversion is performed based on the second field conversion parameter 5042.

Although n is 2 and therefore the field identification signal is a binary toggle signal in the above-mentioned example of the n-fold rate impulse drive, the field identification signal is desirably realized with a count of the number of fields for n of 3 or more.

FIG. 6 shows the field conversion vertical sync signal 621 and the field conversion data 5032 included in the field conversion control signals 5031 generated by the data conversion circuit 5030. The field conversion vertical sync signal 621 defines one field period of the field conversion data 5032.

In FIG. 6, the character F1(*i*) designates the n-fold rate display data of the ith frame subjected to data conversion for a bright field. In similar fashion, F1(*i*+1) designates the n-fold rate display data of the (i+1)th frame subjected to data conversion for a bright field. In FIG. 6, the character Fd(i), on the other hand, designates the n-fold rate display data of the ith frame subjected to data conversion for a dark field. In similar fashion, Fd(i+1) designates the n-fold rate display data of the (i+1)th frame subjected to the data conversion for a dark field.

Although FIG. 6 shows an example in which the first field is determined as a bright field and the second field as a dark field, the first and second fields may be determined as dark and bright fields, respectively.

Finally, the timing generating circuit 5050 generates the output display data 5052 (not shown in FIG. 6) from the field conversion data 5032.

Also, the timing generating circuit 5050 generates the output control signals 5051 from the field conversion control signal group 5031 generated by the data conversion circuit 5030.

Incidentally, as shown in FIG. 6, a delay is caused generally by the data conversion process between the n-fold rate vertical sync signal 611 and the n-fold rate display data 5012 on the one hand and the field vertical sync signal 621 and the field conversion data 5032 on the other hand.

In the configuration of the display device described above, the n-fold rate impulse-type drive as shown in FIG. 1 can be realized and a satisfactory dynamic image quality with a reduced dynamic image blur can be obtained.

Now, a second embodiment of the invention is explained with reference to FIGS. 7 and 8.

Figure 7:
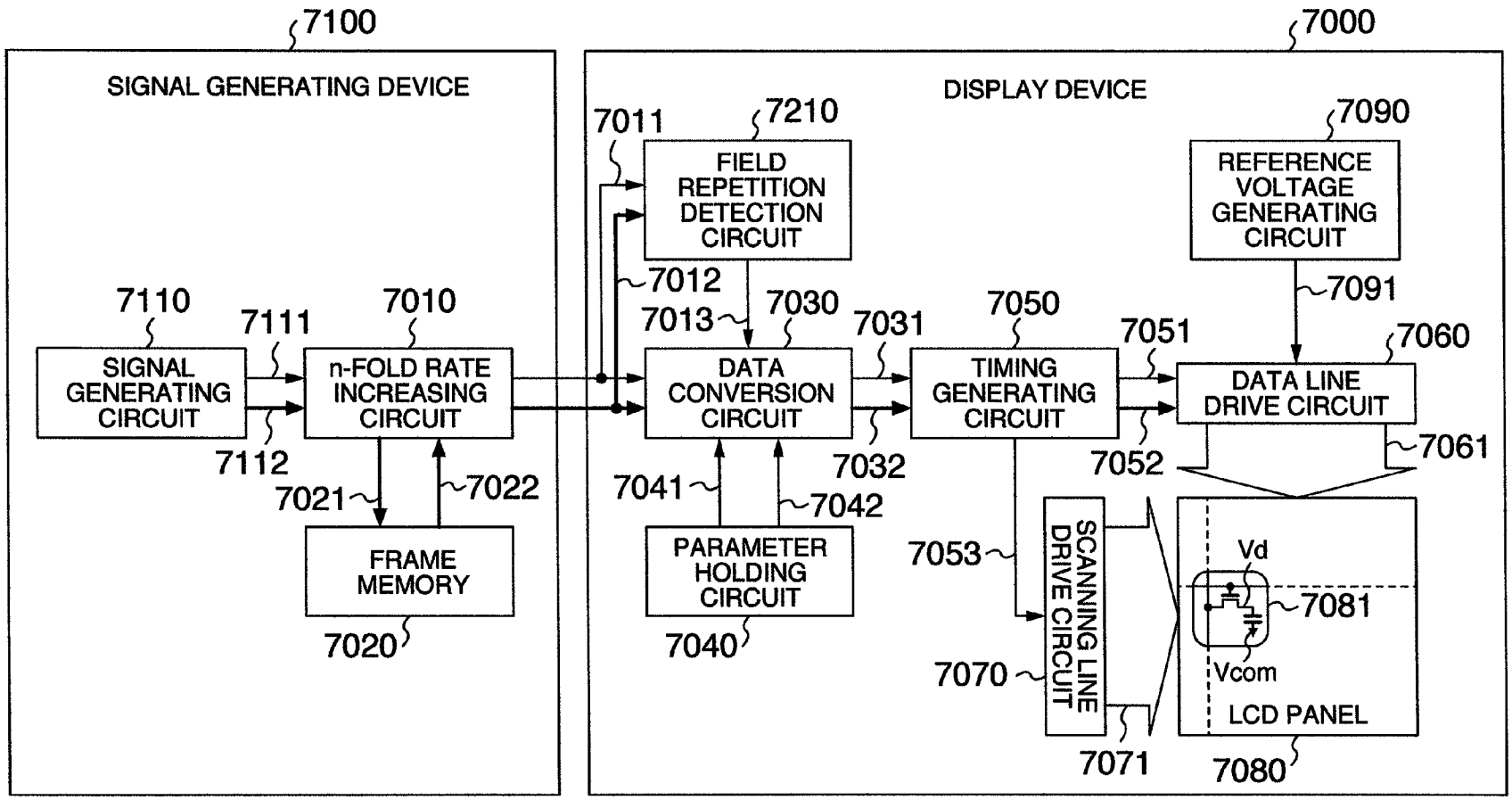
FIG. 7 is a diagram showing an example of the configuration of the display device and the display system according to a second embodiment of the invention.

FIG. 7 is a diagram showing an example of the configuration of the display system and the display device according to an embodiment of the invention for realizing the n-fold rate impulse-type drive while solving the problems described above.

The configuration of this embodiment is different from the configuration shown in FIG. 4A in that a field repetition detection circuit 7210 is arranged on the display device 7000 side instead of inputting the control signal 7111 of the original display data 7112 from the signal generating device 7100 to the display device 7000, and that the n-fold rate display data 7012 and the n-fold rate control signal group 7011 are transmitted from the signal generating device 7100 to the display device 7000. The other points are similar to those of the configuration shown in FIG. 4A and not described any more. The configuration shown in FIG. 4B, as already explained, poses the problem that the turn of the frames of the original input display data cannot be identified. The configuration of FIG. 7 provides a means for solving this problem.

In the case shown in FIG. 7, the display device 7000 includes the field repetition detection circuit 7210. The field repetition detection circuit 7210, supplied with the n-fold rate display data 7012 and the n-fold rate control signal group 7011, has the function of detecting the repetition of the field of the n-fold rate display data 7012, and in the case where the field of the same contents is repeated, determines that the original input display data 7112 has the same frame, while in the case where the field of the same contents is not repeated, it is determined that the frame has been changed and the determination result is output as a field identification signal 7013.

FIG. 8 is a diagram showing an example of the configuration of the field repetition detection circuit 7210.

The field repetition detection circuit 7210 includes a field feature amount extraction circuit 810, a field feature amount discrepancy degree calculation circuit 830, a field repetition identification circuit 840 and a memory 820.

The field feature amount extraction circuit 810 extracts the feature amount 811 indicating the feature of each field of the n-fold rate display data 7012. The feature amount 811 is an indicator of the feature of the video data and can use, for example, the average brightness level, the maximum brightness level, the minimum brightness level, the brightness distribution histogram, the frequency spectrum distribution, the hash value of the data, the cyclic redundancy code of the data and the reduced image of the video data. Alternatively, a vector with a plurality of these factors combined may be used as a feature amount. Also, the data amount of the feature amount is desirably smaller than the data amount for one field of the n-fold rate display data.

The memory 820 has the function of writing the feature amount 811 of the current field extracted by the feature amount extraction circuit 810 and reading the feature amount 821 of the immediately preceding field. The memory 820 has a memory capacity sufficient to hold the feature amount for at least one field period. Since the data amount of the feature amount is smaller than the data amount for one field, the memory 820 can be realized with a capacity smaller than the frame memory and can decrease the cost.

The memory 820 can be constituted of, for example, any of various DRAMs (dynamic random access memories).

The field feature amount discrepancy degree calculation circuit 830 compares the feature amount 811 of the current field with the feature amount 821 of the immediately preceding field and, by arithmetic operation, calculates the discrepancy degree 831 between the two fields. The difference between the feature amounts of the two fields, for example, may be used as the discrepancy degree 831 between the two fields. In the case where the feature amount is a vector having a plurality of dimensions, on the other hand, the cosine value of the angle between the feature amount vector of the current field and the feature amount vector of the immediately preceding field can be regarded as the discrepancy degree between the two fields.

The field repetition identification circuit 840, from the magnitude 831 of the discrepancy degree of the field feature amount, determines whether the two fields coincide with each other, i.e. the same field is repeated or the two fields fail to coincide with each other, i.e. the original frame is changed. In the case where the discrepancy degree 831 is smaller than a predetermined threshold value, for example, it is determined that the two fields are a repetition of the same field, while in the case where the discrepancy degree 831 is larger than the predetermined threshold value, on the other hand, it is determined that the original frame is changed. As a result, the field identification signal 7013 can be generated.

The data conversion circuit 7030 shown in FIG. 7, supplied with the field identification signal 7013, can perform the data conversion by selecting the parameter of an appropriate field.

The operation of the display device and the display system shown in FIG. 7 is similar to the operation shown by the timing chart of FIG. 6 and therefore not explained again. In FIG. 6, the field identification signal 7013 corresponds to the field identification signal 613.

An example of the configuration of the display device according to an embodiment of the invention is explained above.

This configuration of the display device and the display system can realize the n-fold rate impulse-type drive shown in FIG. 1 and thereby produce a satisfactory image quality reduced in the blur of the dynamic image.

Third Embodiment

Figure 9A:
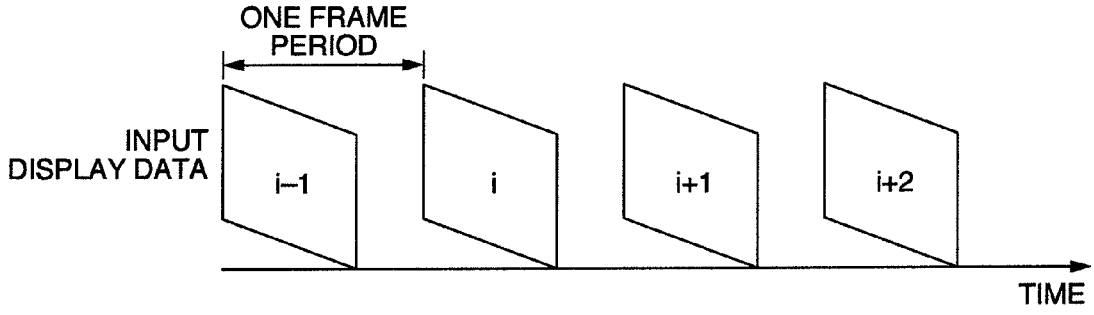
FIGS. 9A to 9C are diagrams for explaining the concept of the double-rate impulse-type drive according to a third embodiment of the invention.
Figure 9B:
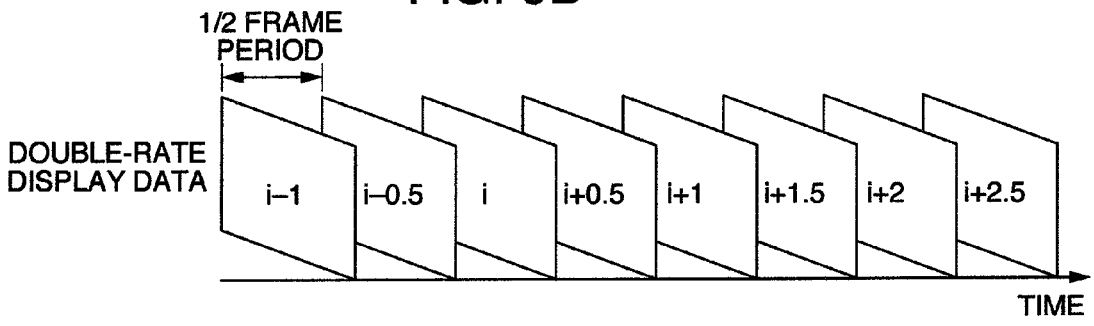
Figure 9C:
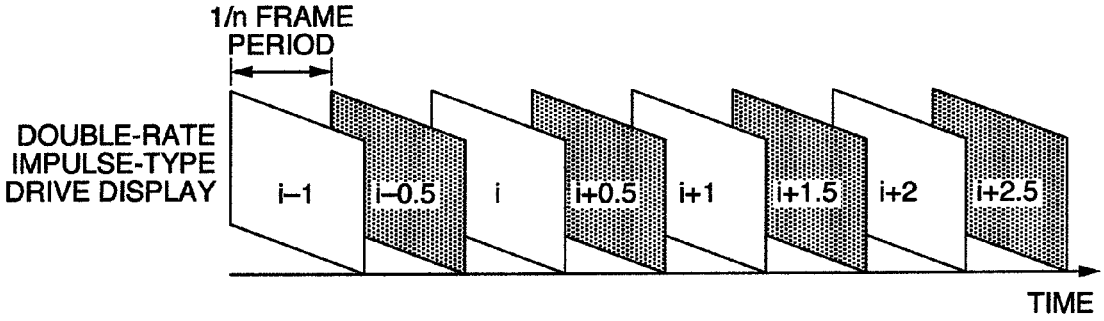

Next, an example of application of the technique according to the invention to the signal generating device including the frame rate conversion unit is explained with reference to FIGS. 2, 5, 6, 9A to 9C and 10. The frame rate conversion unit is a device, as described in JP-A-2003-333540, for example, to generate the video signal between the frames using the motion vector or the like from the interframe video signal. The application of this disclosed technique to the liquid crystal display device can reduce the motion judder, for example, in the PAL-NTSC conversion as described in JP-A-2003-333540. Further, the conversion from 60 Hz to 120 Hz can improve the blur of the dynamic image. In the conversion from 60 Hz to 120 Hz, as shown in FIG. 9A, the n-fold rate display data of 120 Hz designated by i−1, i−0.5, i, i+0.5 and so on shown in FIG. 9B are generated from the 60-Hz input display data designated by i−1, i, i+1 and so on. In FIGS. 9A and 9B, the display data indicated by i−1, 1, i+1 with the affixed numerals of an integer are hereinafter referred to as a real frame display data, and the display data indicated by i−0.5, i+0.5 with affixed numerals of a decimal number are referred to as an interpolation frame display data. The real frame display data in the frames having the same affixed numerals in FIGS. 9A and 9B are regarded as the same display data.

The signal generating device including the frame rate conversion unit described above can be configured of the n-fold rate increasing circuit 5010 shown in FIG. 5.

Figure 10:
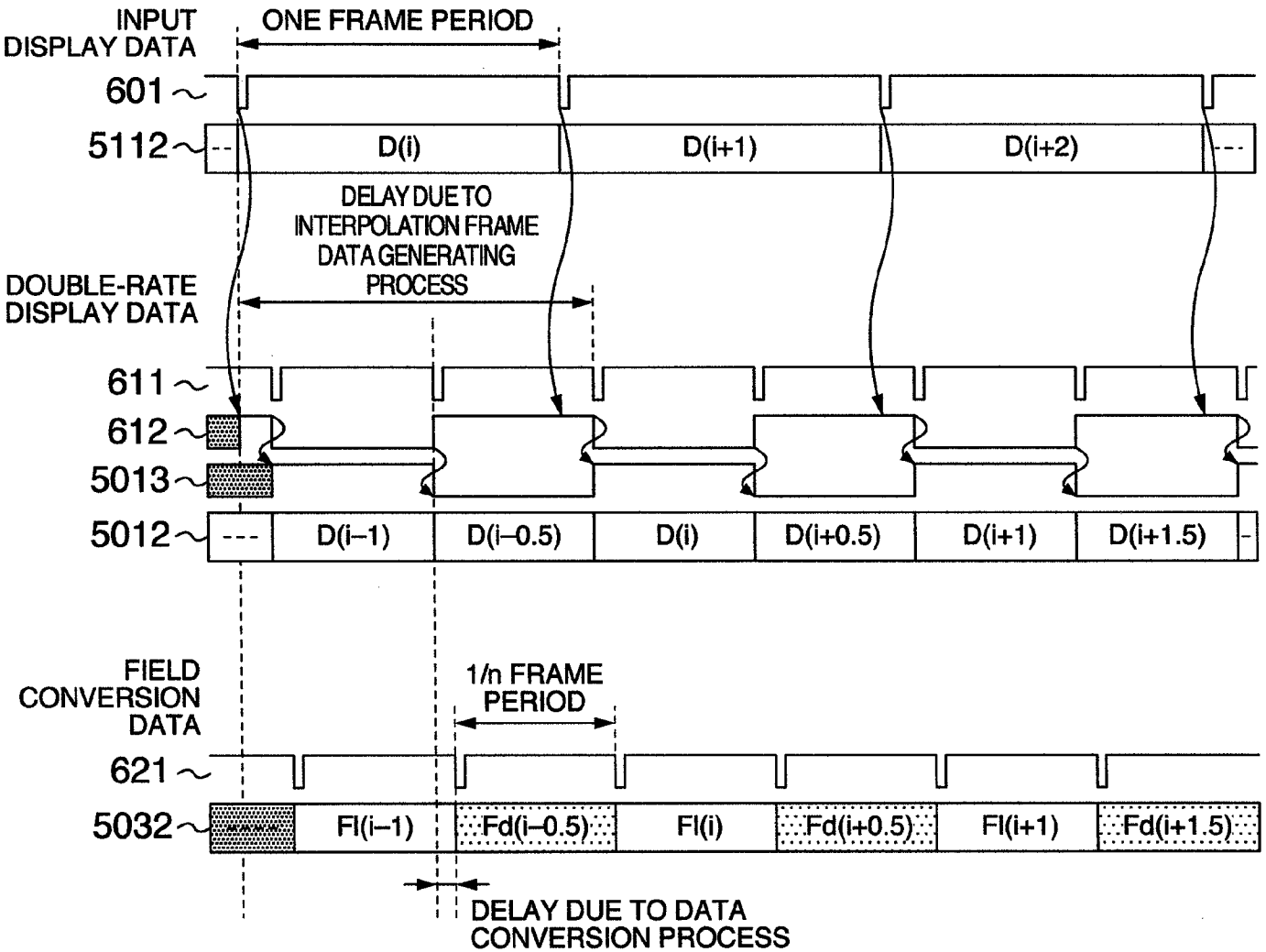
FIG. 10 is a diagram showing an example of the operation of the display device and the display system according to the third embodiment of the invention.

In the case where the interpolation display data for the (i+0.5)th frame is generated using the real frame display data of the ith and (i+1)th frames, the timing of the input display data and the double-rate display data are so related to each other that the display start point of the real frame image is delayed by one frame period as shown in FIG. 10. In the case where the signal level of the field identification signal 5013 is low in the display system shown in FIG. 5, the particular frame may be considered to represent an interpolation frame display data.

The data conversion circuit 5030 receives as an input thereto the field identification signal 5013 output from the field identification signal generating circuit 5200 and the double-rate display data 5012 output from the double-rate increasing circuit 5010. The data conversion circuit 5030 discriminates the real frame and the interpolation frame based on the field identification signal 5013, and in the case where the double-rate display data is the real frame display data (i.e. in the case where the field identification signal 5013 is high in level), the data conversion is effected to achieve the characteristic 203 of the bright field shown in FIG. 2, while in the case where the double-rate display data is the interpolation frame display data (i.e. in the case where the field identification signal 5013 is low in level), on the other hand, the data conversion is carried out to achieve the characteristic 202 of the dark field shown in FIG. 2.

As described above, according to this embodiment, the data is converted in such a manner that the real frame display data represents a bright frame and the interpolation frame display data a dark frame. The interpolation frame display data is generated from the real frame display data, and therefore, is basically lower in accuracy than the real frame display data equivalent to the input frame display data. This compares with the impulse-type drive system according to this invention in which, as described in the first embodiment, the average brightness for n frames (n=2 in this embodiment) is observed, and therefore, even in the case where the interpolation frame display data low in accuracy is regarded as a dark field and therefore the interpolation is not accurate, the resulting image disturbance can be suppressed. Further, the impulse conversion taking the direction of movement of the line of sight into consideration can reduce what is called the pseudo contour posing the problem in the impulse response.

This invention is applicable to the TV display device.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A display device comprising:

a display panel having an array of a plurality of pixels;

a first drive circuit for outputting a display signal corresponding to the display data to the pixels; and a second drive circuit for outputting to the pixels a select signal for selecting the pixels to receive the display signal;

wherein a first display data and a first sync signal indicating the turn of each frame of the first display data are received as an input, and the second display data is displayed using a second display data obtained by converting the first display data through a data conversion circuit according to a predetermined data conversion rule and a second sync signal indicating the turn of each frame of the second display data;

wherein the data conversion circuit includes n (n: an integer of 2 or more) data conversion rules and a select circuit for selecting one of the n data conversion rules;

wherein the select circuit selects the n data conversion rules sequentially from the first to nth data conversion rules;

wherein the data conversion rules are switched in synchronism with the first display data using the first sync signal;

wherein the select circuit includes a circuit for generating an identification signal for identifying each of the n frames of the first display data to select one of the n data conversion rules; and wherein the signal generating circuit generates the identification signal using the first sync signal, the first display data and a third sync signal input separately from the first sync signal.

2. The display device according to claim 1, wherein the third sync signal generates an event at the rate of once every n events generated by the first sync signal.

3. The display device according to claim 2, wherein the first sync signal is the vertical sync signal of the first display data.

4. The display device according to claim 3, comprising the display device described in claim 1 and a signal generating device for generating the first sync signal, the first display data and the third sync signal input to the display device;

wherein the signal generating device includes a signal generating circuit for generating the third display data;

wherein the first display data is equivalent to the third display data with the frame frequency thereof multiplied by n;

wherein the signal generating device includes an n-fold rate increasing circuit for generating the first display data from the third display data;

wherein the n-fold rate increasing circuit outputs the third display data n times during one frame period of the third display data and thus converts the third display data into the first display data; and wherein the third sync signal defines the turn of each frame of the third display data.

5. The display device according to claim 2, comprising the display device described in claim 1 and a signal generating device for generating the first sync signal, the first display data and the third sync signal input to the display device;

wherein the signal generating device includes a signal generating circuit for generating the third display data;

wherein the first display data is equivalent to the third display data with the frame frequency thereof multiplied by n;

wherein the signal generating device includes an n-fold rate increasing circuit for generating the first display data from the third display data;

wherein the n-fold rate increasing circuit outputs the third display data n times during one frame period of the third display data and thus converts the third display data into the first display data; and wherein the third sync signal defines the turn of each frame of the third display data.

6. A display system comprising the display device described in claim 1 and a signal generating device for generating the first sync signal, the first display data and the third sync signal input to the display device;

wherein the signal generating device includes a signal generating circuit for generating the third display data;

wherein the first display data is equivalent to the third display data with the frame frequency thereof multiplied by n;

wherein the signal generating device includes an n-fold rate increasing circuit for generating the first display data from the third display data;

wherein the n-fold rate increasing circuit outputs the third display data n times during one frame period of the third display data and thus converts the third display data into the first display data; and wherein the third sync signal defines the turn of each frame of the third display data.

7. The display system according to claim 6, wherein the third sync signal is the vertical sync signal of the third display data.

8. The display device according to claim 7, wherein at least one of the n data conversion rules is used for data conversion to display the data with a higher brightness than the first display data;

wherein at least one of the n data conversion rules is used for data conversion to display the data with a lower brightness than the first display data; and wherein the n data conversion rules are adjusted in advance in such a manner that the brightness recognized by displaying a series of the n second display data obtained by n data conversions is equivalent to the brightness recognized by displaying the third display data directly during one frame period of the third display data.

9. The display system according to claim 6, wherein at least one of the n data conversion rules is used for data conversion to display the data with a higher brightness than the first display data;

wherein at least one of the n data conversion rules is used for data conversion to display the data with a lower brightness than the first display data; and wherein the n data conversion rules are adjusted in advance in such a manner that the brightness recognized by displaying a series of the n second display data obtained by n data conversions is equivalent to the brightness recognized by displaying the third display data directly during one frame period of the third display data.

10. A display device comprising a display panel having an array of a plurality of pixels, a first drive circuit for outputting a display signal corresponding to the display data to the pixels, and a second drive circuit for outputting to the pixels a select signal for selecting the pixels to receive the display signal;

wherein a first display data and a first sync signal indicating the turn of each frame of the first display data are received as an input, and the second display data obtained by converting the first display data through a data conversion circuit according to a predetermined data conversion rule is displayed using a second sync signal indicating the turn of each frame of the second display data;

wherein the data conversion circuit includes n (n: an integer of 2 or more) data conversion rules and a select circuit for selecting one of the n data conversion rules;

wherein the select circuit selects the n data conversion rules sequentially from the first to nth data conversion rules;

wherein the data conversion rules are switched in synchronism with the first display data using the first sync signal;

wherein the select circuit includes a circuit for generating an identification signal for identifying each of the n frames of the first display data to select one of the n data conversion rules; and wherein the identification signal generating circuit has such a function that a frame turn is detected according to whether the first display data is input in the form of a repetition of a frame having the same contents as the immediately preceding frame or in the form of a frame having different contents from the immediately preceding frame, and in the case where the same frame is input repetitively, the identification signal is updated sequentially in synchronism with the first sync signal, while in the case where the frame is changed, the identification signal is reset.

11. A display system comprising the display device of claim 10 and a signal generating device having the function of generating the first sync signal input to the display device and the first display data;

wherein the signal generating device includes a signal generating circuit for generating the third display data;

wherein the first display data is equivalent to the third display data with the frame frequency thereof multiplied by n;

wherein the signal generating device includes an n-fold rate increasing circuit for generating the first display data from the third display data; and wherein the n-fold rate increasing circuit converts the third display data into the first display data by outputting the third display data n times during one frame period of the third display data.

12. The display system according to claim 11, wherein at least one of the n data conversion rules is used for data conversion to display the data with a brightness higher than the first display data;

wherein at least one of the n data conversion rules is used for data conversion to display the data with a brightness lower than the first display data; and wherein the n data conversion rules are adjusted in advance in such a manner that the brightness recognized by displaying a series of the n second display data obtained by n data conversions is equivalent to the brightness recognized by displaying the third display data directly during one frame period of the third display data.

13. A display system comprising the display device described in claim 10 and a signal generating device having the function of generating the first sync signal and the first display data input to the display device;

wherein the signal generating device includes a signal generating circuit for generating the third display data;

wherein the first display data includes the third display data and the fourth display data generated based on the direction of motion between the frames from the third display data and having the frame frequency doubled by selecting the third and fourth display data alternately; and wherein it is determined based on the first sync signal whether the first display data is the third display data or the fourth display data, and the select circuit is selected based on the determination result, while at the same time converting the data in such a manner that the data conversion result of the same display data has the brightness higher or equal to that of the fourth display data.

14. A display device comprising a display panel with a plurality of pixels in array, a conversion circuit for converting the display data, a first drive circuit for outputting a display signal corresponding to the display data after conversion to the pixels, and a second drive circuit for outputting to the pixels a select signal for selecting the pixels to receive the display signal;

wherein a first display data and a first sync signal indicating the turn of each frame of the first display data are received as an input, and the second display data is displayed using a second display data obtained by converting the first display data through a data conversion circuit according to a predetermined data conversion rule and a second sync signal indicating the turn of each frame of the second display data;

wherein one frame period is divided into n (n: integer of 2 or more) field periods;

wherein the conversion circuit inputs the display data for one frame multiplied by n along the time axis to each field period in the one frame period and converts the input display data into selected one of a bright field data brighter than the display data and a dark field data darker than the display data in accordance with the field period;

the display device further comprising a circuit for generating a field identification signal for determining the number of the field periods before and including the field period involved in the one frame period, based on the frame sync signal synchronized with the one frame period of the display data before being multiplied by n and the field sync signal synchronized with the field period of the display data after being multiplied by n;

wherein the field generating circuit identifies the first field sync signal after the frame sync signal as the first field period, and thereafter identifies up to the nth field periods in accordance with the field sync signal;

the display device further comprising a signal generating circuit that generates the identification signal using the first sync signal, the first display data and a third sync signal input separately from the first sync signal; and wherein the conversion circuit determines whether the display data is to be converted to the bright field data or the dark field data in accordance with the field sync signal.

15. The display device according to claim 14, further comprising an interpolation circuit for generating the interpolation data for at least one frame based on the motion vector between the frames of the display data input in the frame period and inserting the interpolation data during the field period into the display data input during the frame period;

wherein the conversion circuit converts the display data input during the frame period to the bright field data and the interpolation data input during the field period to the dark field data.

16. The display device according to claim 14, wherein the conversion circuit converts the display data input during the frame period to the bright field data and the display data input during the field period to the dark field data, and wherein the display data input during the field period is generated based on the motion vector between the frames of the display data.

* * * * *